United States Patent [19]

Matsumoto et al.

[11] Patent Number: 4,479,724

[45] Date of Patent: Oct. 30, 1984

[54] WATER-RESISTING STRUCTURE FOR A WATCH

[75] Inventors: Masataka Matsumoto; Toshio Murata, both of Tanashi, Japan

[73] Assignee: Citizen Watch Co., Ltd., Tokyo, Japan

[21] Appl. No.: 525,108

[22] Filed: Aug. 22, 1983

[30] Foreign Application Priority Data

Aug. 24, 1982 [JP] Japan ..... 57-126895[U]
Jan. 21, 1983 [JP] Japan ..... 58-6903

[51] Int. Cl.[3] ..... G04B 37/00
[52] U.S. Cl. ..... 368/291
[58] Field of Search ..... 368/88, 276, 286–292

[56] References Cited

U.S. PATENT DOCUMENTS 3,811,401 5/1974 Diquerez ..... 368/286
4,080,781 3/1978 Klingenberg ..... 368/286
4,244,044 1/1981 Olsson ..... 368/291

FOREIGN PATENT DOCUMENTS 808340 7/1951 Fed. Rep. of Germany ..... 368/286

*Primary Examiner*—Vit W. Miska
*Attorney, Agent, or Firm*—Birch, Stewart, Kolasch & Birch

[57] ABSTRACT

A water-resistant device for a watchcase of a diver's watch having a case body, a back and a glass. The device comprises an O-ring for sealing the watchcase, an annular leaf spring having an elasticity in the axial direction of the watchcase, and a bezel for the glass for compressing the leaf spring so as to urge the glass to the O-ring for maintaining watertightness of the watchcase. The O-ring and leaf spring are such that when the glass is moved by the difference between the pressure in the watchcase and atmospheric pressure, gases in the watchcase leak out through a gap formed by the movement of the glass.

6 Claims, 6 Drawing Figures

WATER-RESISTING STRUCTURE FOR A WATCH

BACKGROUND OF THE INVENTION

The present invention relates to a water-resisting structure for a watch such as a diver's watch.

When a diver works under water for a long period, the diver stays in a capsule and gets out the capsule when working. The air in the capsule is kept at a high pressure according to the depth of the position where the capsule is anchored. If the diver stays in the capsule for a long period, nitrogen in the air in the capsule gradually permeates the blood of the diver.

The nitrogen in the blood anesthetizes the diver and when the amount of nitrogen exceeds a saturation condition, the nitrogen vaporizes, which endangers the like of the diver.

In order to avoid such dangers, the capsule is filled with air in which nitrogen is substituted with harmless helium gas. However, the helium gas has a permeability through the packings used in a diver's watch. Therefore, the helium gas in the capsule gradually enters into the watchcase of the diver's watch through the packings.

As a result, the inner pressure in the watchcase increases as high as that of the capsule. When the capsule is raised, the pressure in the capsule is gradually reduced to return to atmospheric pressure in order to avoid submarine sickness. However the helium gas in the watchcase does not quickly leak out, so that the inner pressure of the watchcase becomes higher than the atmospheric pressure. a large difference between both pressures results in breaking of the glass of the diver's watch or the falling off of parts of the watch.

FIG. 1 shows a conventional watchcase of a diver's watch provided with a structure for exhausting helium gas. A case body 1 has a radial bore 2 having a shoulder 2*a* formed on an inner end portion thereof and a thread 2*b* formed on an outer end portion thereof. In the hole 2, an O-ring 3 is engaged with the shoulder 2*a* and a compression member 4 is engaged with the O-ring 3. A spring 5 is provided between the compression member 4 and another compression member 6 threaded into a thread 2*b* for urging the compression member 4 to the O-ring 3. The compression member 6 has a perforation 7 for communicating the interior with the atmosphere. A gap is provided between the compression member 4 and the inner wall of the hole 2.

For a long stay in a capsule, helium gas gradually enters into the watchcase through the O-ring 3 so that the inner pressure of the case becomes rather high. During the reduction of the inner pressure of the capsule, since the inner pressure of the watchcase becomes higher than that of the capsule, the compression member 4 depresses the spring 5 against its elasticity. Thus, the compression force to the O-ring 3 is decreased to leak the helium gas in the watchcase through gaps.

However, in such a structure, the thickness of the watchcase is increased because of many structural parts and the bore 2 is exposed to the outside, which impairs the appearance of the watch.

SUMMARY OF THE INVENTION

An object of the present invention is to provide a diver's watch having a structure for the exhausting of inner gas which does not detract from the appearance of the watch and which may be made without increasing the thickness of the case.

Another object of the present invention is to provide a diver's watch to improve reliability of a water-resisting effect.

According to the present invention, there is provided a water-resisting device for a watchcase having a case body, a back and a glass, comprising a sealing member made of compressible material for sealing the watchcase; a movable member which is moved in the axial direction of the watchcase by the difference between the pressure in the watchcase and atmospheric pressure; and an elastic member for urging the movable member to the sealing member for maintaining watertightness of the watchcase. The sealing member and elastic member are such that when the movable member is moved by the difference, gases in the watchcase leak out through a gap formed by the movement of the movable member.

Other objects and features of the present invention will become more apparent from the following description with reference to the accompanying drawings.

Figure 1:
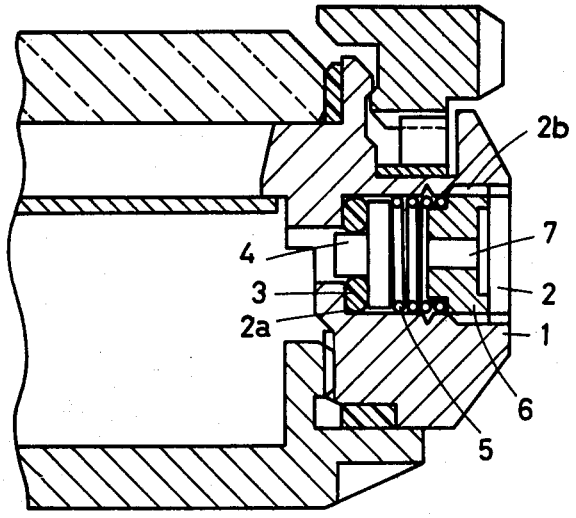
FIG. 1 is a sectional view of a part of a conventional diver's watch.
Figure 2:
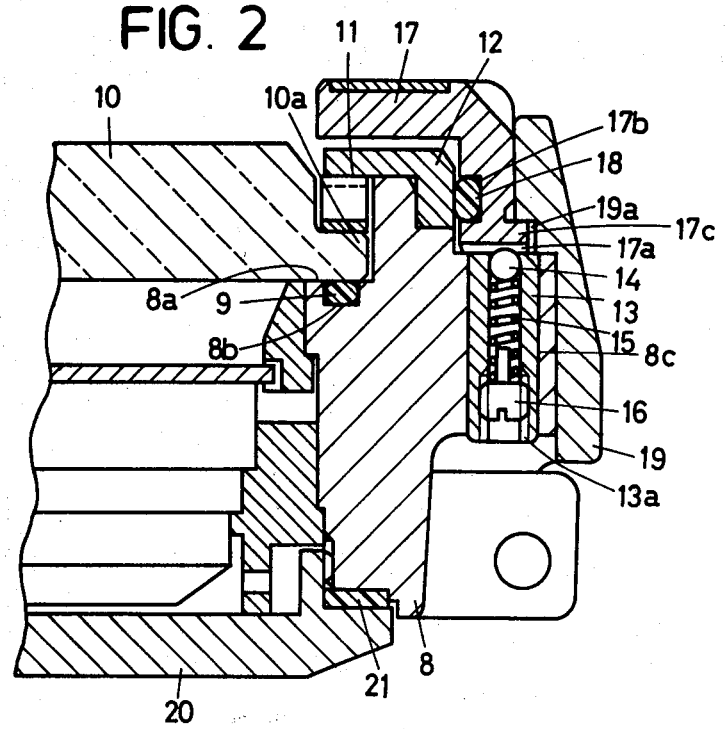
FIG. 2 is a sectional view of a diver's watch according to the present invention in normal state.
Figure 3:
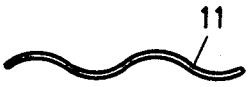
FIG. 3 is a side view showing a part of an annular leaf spring.
Figure 4:
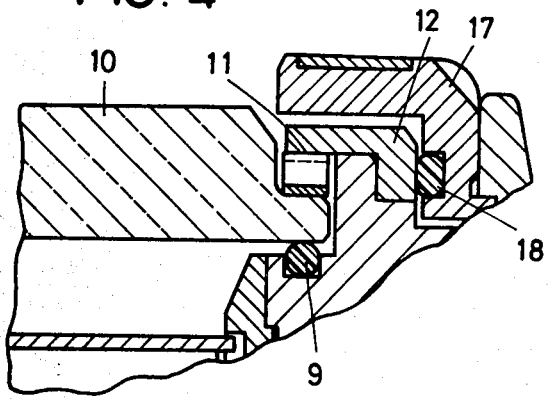
FIG. 4 shows a part of FIG. 1 when the inner pressure of the case is higher than the atmospheric pressure.

DESCRIPTION OF THE PREFERRED EMBODIMENTS:

Referring to FIGS. 2 to 4, a watchcase of a diver's watch according to the present invention comprises a case body 8, a glass 10 having a peripheral fixing flange 10*a*, a register ring 17 and a back 20. The case body 8 comprises a radially extending inside upper engaging portion 8*a* provided with an annular groove 8*b* in which an O-ring 9 is engaged. The glass 10 is mounted on the upper inside portion 8*a* interposing the O-ring 9. An annular leaf spring 11 which is corrugated as shown in FIG. 3, is mounted on the flange 10*a* and is held down by a bezel 12 which is fixed to the case body 8 by snug fitting. Thus, the glass 10 is pressed against the O-ring 9 by the bezel 12 through the leaf spring 11. The bezel 12 may be fixed to the case body 8 in another manner such as by means of screws.

For locking structure of the register ring 17, a hole 8*c* is axially bored at an outer periphery of the case body 8, in which a pipe 13 is embedded. The inner diameter of the upper opening of the pipe 13 is smaller than that of the lower opening. Therefore, a steel ball 14 inserted into the pipe 13 from the lower opening is prevented from passing through the pipe. The steel ball 14 is raised up by a coil spring 15, a lower end of which is engaged with a screw 16. The screw 16 is threaded into a thread 13*a* formed in an inner periphery of a lower portion of the pipe 13 so as to close the lower opening of the pipe 13.

The register ring 17 provided on the upper portion of the case body 8 has a plurality of serrated notches 17*a* formed on the underside thereof and the steel ball 14 is engaged with one of the notches 17*a* for selectively setting the angular position of the register ring in the rotating direction. An O-ring 18 is engaged in an annular groove 17*b* formed on the inner periphery portion of the register ring 17 and is abutted to the axially extending wall portion of the bezel 12 for ensuring smooth rotation of the register ring 17. A flange portion 17*c* formed on a lower peripheral portion of the register ring 17 is slidably engaged with an underside of an overhang 19*a* formed on the inside of an outer case body 19. The back 20 is secured to the case body 8 by thread engagement interposing a packing 21.

Under normal conditions shown in FIG. 2, the glass 10 is securely engaged with the inside upper portion 8*a* being depressed by the leaf spring 11 so that the O-ring 9 provided in the annular groove 8*b* is greatly compressed to maintain a sufficient water-tightness.

As shown in FIG. 4, when the pressure in the watchcase becomes higher than atmospheric pressure, the glass 10 is moved in the axial direction of the watchcase by the pressure difference against the elasticity of the leaf spring 11. The compression force exerted on the O-ring 9 decreases so that the gases in the watchcase leak out through gaps between the glass 10 and O-ring 9. At that time, since gases flow from the inside of the watchcase to the outside, the watertightness is sufficiently maintained. When the pressure in the watchcase becomes equal to the atmospheric pressure, the glass 10 compresses the O-ring 9 by the elasticity of the leaf spring 11.

Figure 5:
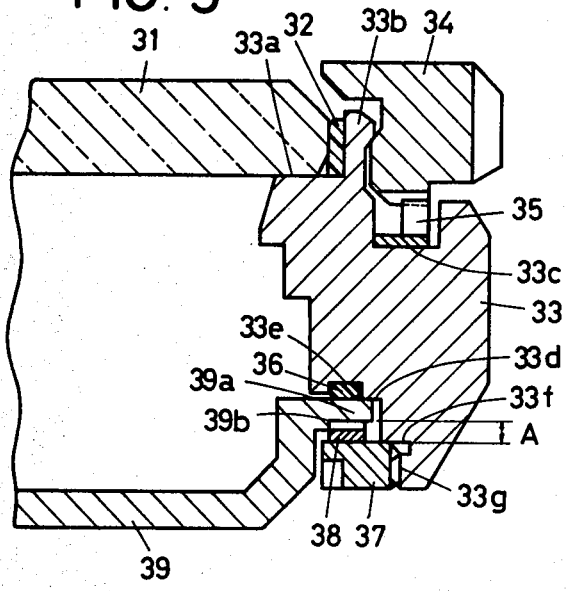
FIG. 5 is a sectional view of another embodiment of the present invention.
Figure 6:
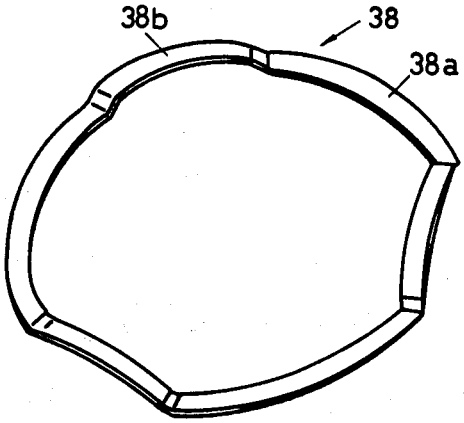
FIG. 6 is a perspective view of an annular spring plate.
Figure 7:
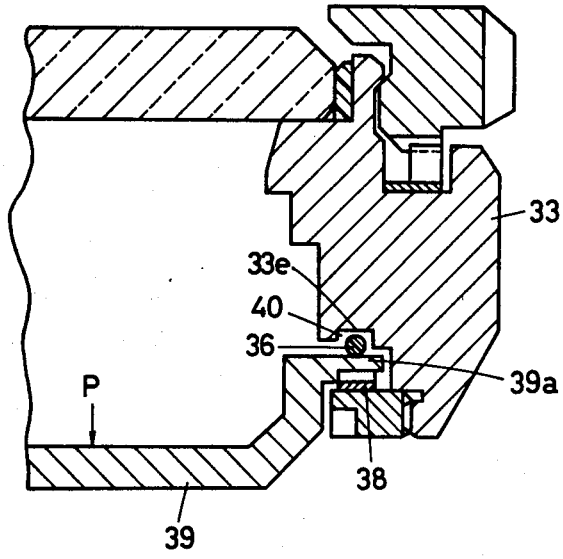
FIG. 7 is a sectional view showing a state when the inner pressure is higher than the atmospheric pressure.

FIGS. 5 to 7 show another embodiment of the present invention. A glass 31 is engaged with an inside upper portion 33*a* of a case body 33 interposing a packing 32 for providing a watertightness. A register ring 34 is rotatably engaged with an upright portion 33*b* of the case body 33 and is elevated by a register ring spring 35 secured to an annular groove 33*c*. The case body 33 further comprises an underside engaging portion 33*d* formed in a lower inside portion thereof provided with an annular groove 33*e* for an O-ring 36, a shoulder 33*f* formed in a position lower than the engaging portion 33*d* and a thread 33*g* formed in the lowermost inside wall for engaging a back securing ring 37.

As shown in FIG. 6, an annular spring plate 38 having a corrugated shape has a plurality of elastic portions 38*b* projected from a flat portion 38*a*.

A back 39 has a flange 39*a* which is engaged with the engaging portion 33*d*. The flat portion 38*a* of the spring 38 is engaged with an underside engaging portion 39*b* of the flange 39*a* and the elastic portion 38*b* is engaged with the surface of the back securing ring 37. The elastic portion 38*b* of the spring 38 is compressed by the back securing ring 37 threaded into the thread 33*g* so that the back 39 is upwardly urged to compress the O-ring 36 for providing a watertightness. In that state, the securing ring 37 is abutted on a shoulder 33*f* and the compression force is controlled by the distance between the shoulder 33*f* and engaging portion 39*b*.

FIG. 7 shows an exhausting state of helium gas from the watchcase. An arrow P shows an inner pressure of the watchcase exerted on the back 39 and the back depresses the spring 38 through the flange 39*a*. By the compression, the elastic portion 38*b* is deflected to move the back 38 outwardly and the O-ring 36 is relieved for providing a gap 40 between the O-ring 36 and the annular groove 33*e* of the case body 33. Thus, gases in the watchcase are discharged through the gap 40.

In accordance with the present invention, since gases in the watchcase automatically leak out by the difference between the inner pressure and atmospheric pressure with the deflection of the leaf spring, the reliability of the water-resisting is ensured. Further, since the exhausting structure is hidden, the appearance of the watch is not affected.

While the invention has been described in conjunction with preferred specific embodiments thereof, it will be understood that this description is not intended to limit the scope of the invertion as defined by the following claims.

What is claimed is;

1. A water-resisting device for a watchcase having a case body, a back and a glass, comprising a sealing member made of compressible material for sealing said watchcase;

a movable member which is moved in the axial direction of the watchcase by the difference between the pressure in the watchcase and atmospheric pressure; and an elastic member for urging said movable member to said sealing member for maintaining watertightness of the watchcase;

said sealing member and elastic member being such that when said movable member is moved by said difference, gases in the watchcase leak out through a gap formed by the movement of the movable member.

2. The water-resisting device for a watchcase according to claim 1 wherein said sealing member is an O-ring and said elastic member is an annular leaf spring.

3. The water-resisting device for a watchcase according to claim 2 wherein said movable member is the glass.

4. The water-resisting device for a watchcase according to claim 2 wherein said movable member is the back.

5. The water-resisting device for a watchcase according to claim 3 wherein said O-ring is provided in a groove formed in an upper portion of said case body, said leaf spring is compressed by a bezel secured to said case body so as to urge said glass to said O-ring.

6. The water-resisting device for a watchcase according to claim 4 wherein said O-ring is provided in a groove formed in an underside of said case body, said leaf spring is compressed by a back securing ring secured to said case body so as to urge said back to said O-ring.

* * * * *